US005724849A

United States Patent [19]

Frossard, Jr.

[11] Patent Number: 5,724,849

[45] Date of Patent: Mar. 10, 1998

[54] PROCESS FOR FORMING A TUBE FOR USE IN A SOUND ATTENUATING MUFFLER

[75] Inventor: Norman J. Frossard, Jr., Aberdeen, Miss.

[73] Assignee: Tanneco Automotive Inc.

[21] Appl. No.: 741,944

[22] Filed: Oct. 31, 1996

[51] Int. Cl.[6] ..... B21D 41/00

[52] U.S. Cl. ..... 72/369; 72/420

[58] Field of Search ..... 269/303, 305; 72/369, 370, 420

[56] References Cited

U.S. PATENT DOCUMENTS

| | | | |
|---|---|---|---|
| 2,466,877 | 4/1949 | Cross . | |
| 2,516,372 | 7/1950 | Cross . | |
| 2,971,556 | 2/1961 | Armstrong et al. . | |
| 2,976,908 | 3/1961 | Ferguson . | |
| 3,303,680 | 2/1967 | Thielsch . | |
| 3,473,361 | 10/1969 | Cwik . | |
| 3,622,145 | 11/1971 | Gibson | 269/305 |
| 4,137,743 | 2/1979 | Schwarze . | |
| 4,157,024 | 6/1979 | Kahlow et al. . | |
| 4,157,654 | 6/1979 | Kahlow et al. . | |
| 4,352,281 | 10/1982 | Ragettli | 72/369 |
| 4,464,923 | 8/1984 | Boggs et al. . | |
| 4,722,213 | 2/1988 | Enkvist . | |
| 4,747,768 | 5/1988 | Crupi . | |
| 4,779,436 | 10/1988 | Schwarze . | |
| 4,848,120 | 7/1989 | Schwarze . | |
| 5,214,950 | 6/1993 | Grobbenhaar . | |
| 5,257,524 | 11/1993 | Jung . | |
| 5,290,166 | 3/1994 | Heatherly . | |
| 5,337,590 | 8/1994 | Schuchert et al. . | |
| 5,343,725 | 9/1994 | Sabine . | |

*Primary Examiner*—Lowell A. Larson

*Attorney, Agent, or Firm*—Harness, Dickey & Pierce, P.L.C

[57] ABSTRACT

The present invention provides an apparatus and process for shaping at least an end of a tube to a desired form by incremental axis shifting. This is accomplished by providing an apparatus including an inside/outside end sizing machine and a work table having a plurality of stop blocks associated therewith such that an angle cut perforated tube is presented to the machine at preset angles set by the stop blocks. The tube is aligned adjacent the first stop block and is presented to the inside/outside end sizing machine. The machine is then cycled and begins to align the center line of the tube with the center line of the tooling. However, the stop block prevents the tube from moving which results in the axis of the end of the tube being shifted. This process is repeated for a plurality of stop blocks which are used to alter the angle of presentation to the end sizing machine.

20 Claims, 2 Drawing Sheets

PROCESS FOR FORMING A TUBE FOR USE IN A SOUND ATTENUATING MUFFLER

BACKGROUND OF THE INVENTION

1. Technical Field

The present invention relates generally to forming a tube to selected angles along its length, and more particularly to a process for shaping a perforated pipe for use in an automobile sound attenuating muffler.

2. Discussion

Numerous bending processes have been developed over the years, but generally speaking, most such methods are variations of a few basic processes. No single process can be successfully applied to all bending situations where variations of tubular section size, diameter-to-wall thickness ratio, material or angle of bend are considered. For instance, the press method, wherein the tube is laid across a plurality of wiper dies and then subjected to the pressure exerted by a form die, is useful when some flattening of the tubing can be permitted. The roll method of bending employs three or more triangularly arranged rolls, the center one of which is adjustable. The work piece is fed between the fixed, driven rolls and the adjustable roll to form the bend. The draw method bends the tube by clamping it against a rotating form and drawing it through a pressure die.

These "brute force" methods function by stretching the pipe wall material along the outer radius of the bend and by compressing the wall material of the pipe along the inner radius of the bend. In these methods, thinning of the tube wall, especially along the outer bend, and loss of section circularity occurs. The thinner the tube wall and/or the tighter the bend sections, the more severe these problems become. Also, in methods utilizing a bend mandrel, which is inserted into the tube before the drawing operation and is removed after the drawing operation, it has been noticed that the inner surface of the tube has been damaged in connection with the relative motion between the bend mandrel and the tube wall. Furthermore, a perforated tube subjected to bending operations is typically torn and collapses across the perforations by prior art processes.

As is known, it is desirable in some automobile exhaust systems to incorporate a sound attenuating muffler which includes a perforated tube running from an inlet to an offset outlet across the cavity of the muffler housing. For best acoustic performance, the entire length of the tube is preferably perforated rather than just perforating a small section along the length of the tube. Also, for best cost effectiveness, the tube is preferably a one piece continuous perforated pipe rather than a build up of two or three pieces of tubing.

In order for the continuous perforated tube to span the cavity between the inlet and offset outlet, the tube must be shaped to a shallow "S" having essentially parallel inlet and outlet sections and an angled section extending therebetween. However, conventional tube bending processes tear and collapse the tube across the perforations.

Accordingly, it is an object of the present invention to provide a tube forming process for shaping the ends of a perforated tube to simulate an "S" shaped bent tube in which the perforated tube is neither torn nor collapsed.

SUMMARY OF THE INVENTION

An apparatus and process is disclosed for shaping at least an end of a tube to a desired form by incremental axis shifting. This is accomplished by providing an apparatus including an inside/outside end sizing machine and a work table having a plurality of stop blocks associated therewith such that an angle cut perforated tube is presented to the machine at preset angles set by the stop blocks. The tube is aligned adjacent the first stop block and is presented to the inside/outside machine. The machine is then cycled and begins to align the center line of the tube with the center line of the tooling. However, the stop block prevents the tube from moving which results in the axis at the end of the tube being shifted. This process is repeated for a plurality of stop blocks which are used to alter the angle of presentation to the end sizing machine.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The following description of the preferred embodiments is merely exemplary and is in no way intended to limit the invention or its application or uses.

Figure 1:
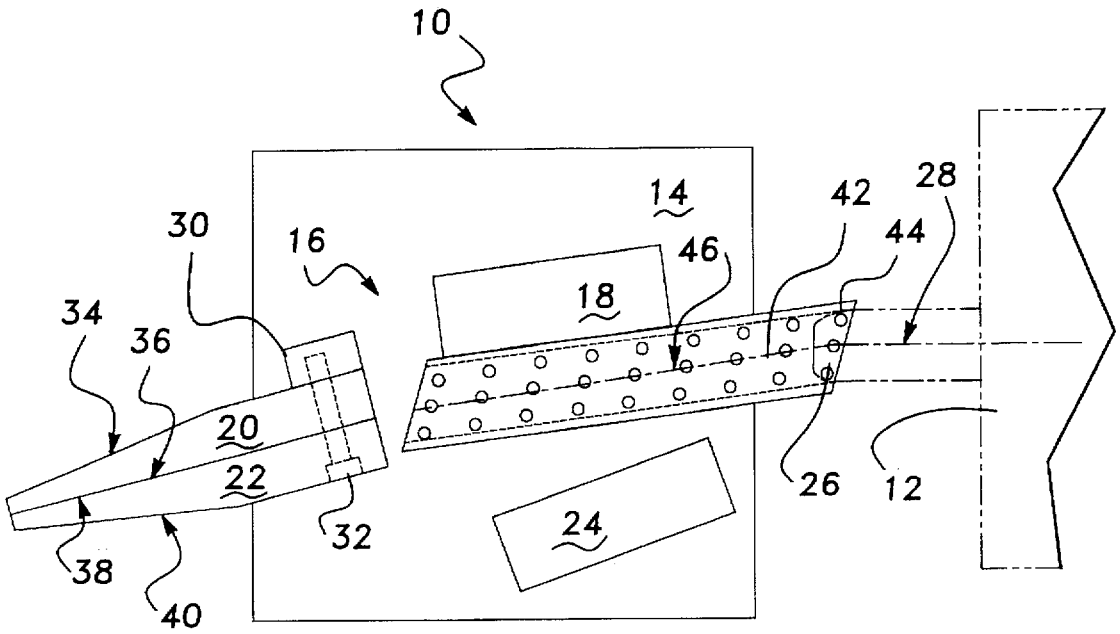
FIG. 1 is a top schematic view of an apparatus for shaping a tube including a plurality of stop blocks secured to a work table, and inside/outside end sizing machine and a perforated tube.

Referring to the drawings, FIG. 1 shows an apparatus 10 for shaping a tube to a desired offset angle. The apparatus 10 includes an inside/outside end shaping machine 12 (also referred to in industry as an I/O sizer or I/O machine and referred to hereinafter as an I/O machine), a work table 14, and a plurality of stop blocks 16. The plurality of stop blocks 16 are secured to the work table 14 in the manner described below.

The plurality of stop blocks 16 preferably includes a first stop block 18, a second stop block 20, a third stop block 22, and a fourth stop block 24. The first stop block 18 is preferably rectangularly shaped and is secured to the work table 14 by bolts, welding, or other conventional means. The first stop block 18 is disposed at a predetermined angle relative to the inside sizing fingers and jaws 26 and tooling center line 28.

The second stop block 20 and third stop block 22 are preferably rotatably secured to a stop block mount 30 by a threaded member or bolt 32 or other conventional means. The second stop block 20 is preferably wedge-shaped such that when it is rotated to a blocking position (see FIG. 2), the edge 34 aligns adjacent the first stop block 18 and the edge 36 forms a second blocking angle with respect to the tooling center line 28. Furthermore, the third stop block 22 is preferably wedge-shaped such that when it is rotated to a blocking position (see FIG. 3), the edge 38 aligns adjacent the second stop block edge 36 and the third stop block edge 40 forms a third blocking angle with respect to the tooling center line 28.

The fourth stop block 24 is secured to the work table 14 by bolts, welding, or other conventional means. Preferably, the fourth stop block 24 is generally rectangularly shaped and is aligned parallel to the third stop block edge 40 when the third stop block 22 is located in its blocking position.

Still referring to FIG. 1, a perforated tube 42 is positioned adjacent the first stop block 18 such that its angle cut end 44 is presented to the I/O machine 12 at a first given angle. By cycling the I/O machine 12, the fingers and jaws 26 capture the end 44 of the tube 42 and exert a force which attempts to align the center line of the tube 46 with the tooling center line 28. However, the first stop block 18 prevents the presentation angle of the tube 42 from changing. This causes the fingers and jaws 26 to shift (or slightly bend) the axis of the angle cut end 44 a predetermined mount.

Figure 2:
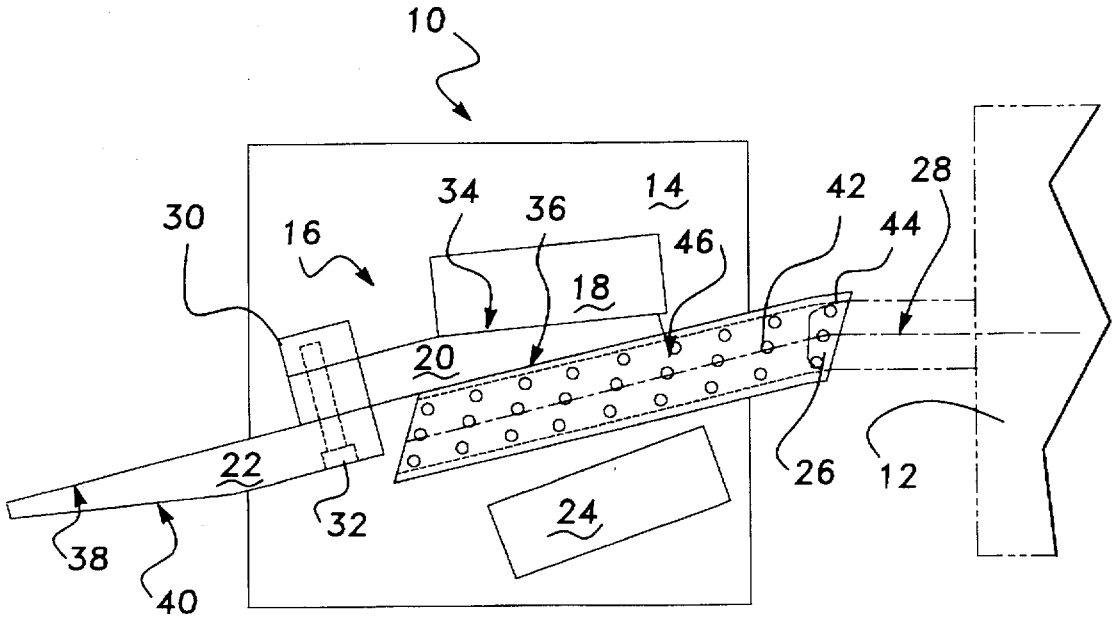
FIG. 2 is a top schematic view of the apparatus depicted in FIG. 1 wherein the second stop block has been rotated such that it is aligned between the first stop block and the perforated tube.

Turning to FIG. 2, the apparatus 10 is arranged for carrying out the second step of the tube-forming process. After the I/O machine 12 is cycled with the tube 42 located in the position shown in FIG. 1, the tube 42 is removed from the fingers and jaws 26 for repositioning. The second stop block 20 is rotated about the bolt 32 from its stored position to its blocking position. In the blocking position, the edge 34 aligns adjacent the first stop block 18 and the edge 36 forms a second blocking or presentation angle to the tooling center line 28. The tube 42 is then positioned in the apparatus 10 adjacent the edge 36 and is presented to the fingers and jaws 26.

With the tube 42 in place, the I/O machine is again cycled and begins to align the center line 46 of the tube 42 with the tooling center line 28. In this case, the second stop block 20 prevents the tube 42 from moving. This interaction causes the I/O machine 12 to shift the axis of the angle cut end 44 behind the bend resulting from the first step such that the first and second bends are coaxial yet angled to the tube center line 46.

Figure 3:
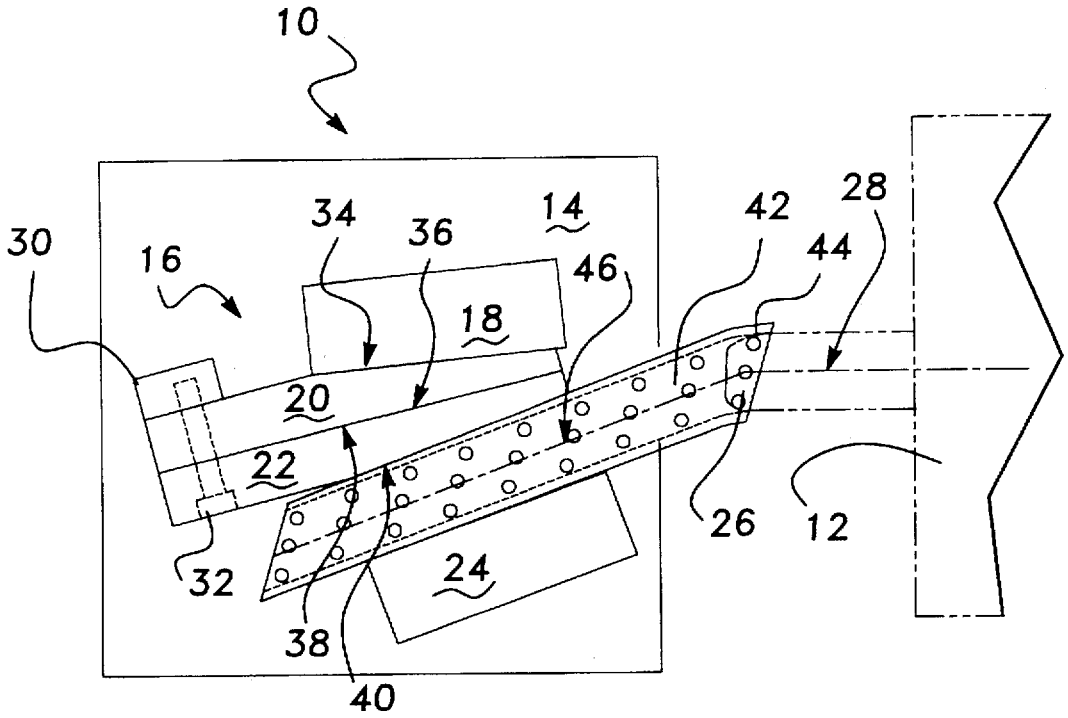
FIG. 3 is a top schematic view of the apparatus in FIG. 2 wherein the third stop block has been rotated such that it is aligned between the second stop block and the perforated tube.

Referring to FIG. 3, the apparatus 10 is shown configured for a third bending step. In this case, the third stop block 22 has been rotated from a stored position into a blocking position such that the edge 38 is aligned adjacent the second stop block 20 and the edge 40 forms a third predetermined angle with respect to the tooling center line 28. The tube 42 is positioned between the third stop block 22 and the fourth stop block 24 such that it is held in place. For this purpose, it is preferable that the angle of the fourth stop block 24 is essentially parallel to the edge 40 of the third stop block 22.

The tube 42 is again presented to the fingers and jaws 26 of the I/O machine 12 which exert a force attempting to align the tube center line 46 with the tooling center line 28. The third stop block 22 prevents the tube 42 from moving which results in the I/O machine 12 shifting the axis of the end 44 behind the bend resulting from the second step. The positioning of the fourth stop block 24 functions to control the bend depth.

Preferably, the tube 42 is then rotated 180° and the above process is repeated for the other end of the tube 42. The result is an offset tube having essentially parallel end portions and an angled portion extending therebetween. The tube may then be effectively used as an internal part of an automotive exhaust system muffler.

Those skilled in the an can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. An apparatus for shaping an object comprising:

a bench;

a plurality of stop blocks coupled to said bench, said blocks being adjustably positionable for fixing said object at a plurality of preselected angles; and an inside/outside end sizing machine proximate said bench and in operative relation with said plurality of stop blocks, said inside/outside end sizing machine having members for capturing an end of said object and aligning a centerline of said end with a centerline of said machine while said stop blocks prevent a remainder of said object from moving from said preselected angle.

2. The apparatus of claim 1 wherein said plurality of stop blocks include:

a first stop block aligned at a first angle to said center line of said inside/outside end sizing machine.

3. The apparatus of claim 2 wherein said plurality of stop blocks includes a second stop block aligned at a second angle to said center line of said inside/outside end sizing machine.

4. The apparatus of claim 3 wherein said plurality of stop blocks includes a third stop block aligned at a third angle to said center line of said inside/outside end sizing machine.

5. The apparatus of claim 4 wherein said plurality of stop blocks includes a fourth stop block aligned at a fourth angle to said center line of said inside/outside end sizing machine.

6. The apparatus of claim 3 wherein said second stop block is rotatable between a stored position and a blocking position.

7. The apparatus of claim 6 wherein said blocking position locates said second stop block adjacent said first stop block.

8. The apparatus of claim 4 wherein said third stop block is rotatable between a stored position and a blocking position.

9. The apparatus of claim 8 wherein said blocking position aligns said third stop block adjacent said second stop block.

10. A method for shaping a tube comprising:

presenting an angle cut end of a tube to an inside/outside end sizing machine at a plurality of preset angles;

capturing an inside and an outside of said end with a member of said inside/outside end sizing machine holding said tube against movement from each of said preset angles; and cycling said inside/outside end sizing machine at each preset angle such that said member shifts a center line of said end to a center line of said inside/outside end sizing machine without shifting a center line of a remainder of said tube.

11. The method of claim 10 further comprising:

aligning said tube along a first stop block at a first angle to a center line of said inside/outside end sizing machine;

presenting said angle cut end of said tube to said inside/outside end sizing machine;

capturing said end with said member; and cycling said machine such that a center line of a first section of said end shifts to said center line of said inside/outside end sizing machine and angled to said remainder of said tube.

12. The method of claim 11 further comprising:

aligning said tube along a second stop block at a second angle to said center line of said inside/outside end sizing machine;

presenting said angle cut end of said tube to said inside/outside end sizing machine;

capturing said end with said member; and cycling said machine such that a center line of a second section of said end shifts to said center line of said inside/outside and sizing machine to be coaxial with said first section and angled to said remainder of said tube.

13. The method of claim 12 further comprising:

aligning said tube along a third stop block at a third angle to said center line of said inside/outside end sizing machine;

presenting said angle cut end of said tube to said inside/outside end sizing machine;

capturing said end with said member; and cycling said machine such that a center line of a third section of said end shifts to said center line of said inside/outside end sizing machine to be coaxial with said first and second sections and angled to said remainder of said tube.

14. The method of claim 10 further comprising the steps of:

aligning said tube along a first stop block at a first angle with respect to a center line of said inside/outside end sizing machine;

presenting said angle cut end of said tube to said machine;

capturing said end with said member;

cycling said machine such that a center line of a first section of said end shifts to said center line of said inside/outside end sizing machine;

positioning a second stop block adjacent said first stop block;

aligning said tube along said second stop block at a second angle to said center line;

presenting said angle cut end of said tube to said machine;

capturing said end with said member;.

cycling said machine such that a center line of a second section of said end shifts to said center line of said inside/outside end sizing machine to be coaxial with said first section.;

positioning a third stop block adjacent said second stop block;

aligning said tube between said third stop block and a fourth stop block at a third angle to said center line;

presenting said angle cut end of said tube to said machine;

capturing said end with said member; and cycling said machine such that a center line of a third section of said end shifts to said centerline of said inside/outside end sizing machine to be coaxial with said first and second sections.

15. The method of claim 14 wherein said step of positioning said second stop block further comprises rotating said second stop block from a stored position to a blocking position adjacent said first stop block.

16. The method of claim 14 wherein said step of positioning said third stop block further comprises rotating said third stop block from a stored position to a blocking position adjacent said second stop block.

17. A method of forming an offset perforated tube for use in an automotive exhaust system comprising:

aligning a perforated tube along a first stop block at a first angle to a center line of an inside/outside end sizing machine;

presenting an angle cut end of said perforated tube to said inside/outside end sizing machine at said first angle;

capturing an inside and an outside of said end with a set of fingers and jaws of said inside/outside end sizing machine;

cycling said machine such that a first section of said end shifts to said center line;

rotating a wedge-shaped second stop block from a stored position to a blocking position adjacent said first stop block such that a blocking edge of said second stop block forms a second angle to said center line;

aligning said perforated tube along said second stop block;

presenting said angle cut end of said perforated tube to said inside/outside end sizing machine;

capturing said end with said fingers and jaws;

cycling said machine such that a second section of said end shifts to said center line to be coaxial with said first section;

rotating a wedge-shaped third stop block from a stored position to a blocking position adjacent said second stop block such that a blocking edge of said third stop block forms a third angle to said center line;

aligning said perforated tube between said third block and a fourth stop block;

presenting said angle cut end of said perforated tube to said inside/outside end sizing machine;

capturing said end with said fingers and jaws; and cycling said machine such that a third section of said end shifts to said center line to be coaxial with said first and second sections.

18. The method of claim 17 wherein said fourth stop block includes a bend depth control edge essentially parallel to said blocking edge of said third stop block.

19. The method of claim 17 further comprising removing said tube from said inside/outside end sizing machine after each cycling step.

20. The method of claim 17 further comprising rotating said perforated tube 180° and repeating said steps for a second angle cut end of said perforated tube.

* * * * *

UNITED STATES PATENT AND TRADEMARK OFFICE
CERTIFICATE OF CORRECTION

PATENT NO. : 5,724,849
DATED : March 10, 1998
INVENTOR(S) : Norman J. Frossard, Jr.

It is certified that error appears in the above-identified patent and that said Letters Patent is hereby corrected as shown below:

Cover Page, at [73] Assignee: "Tanneco" should be --Tenneco".

Column 3, Line 20, "mount" should be --amount--.

Column 3, Line 66, "an" should be --art--.

Column 5, Line 47, Claim 14, after "member" delete ".".

Column 5, Line 51, Claim 14, after "section" delete ".".

Signed and Sealed this

Fourteenth Day of July, 1998

Bruce Lehman

*Attest:*

BRUCE LEHMAN

*Attesting Officer*

*Commissioner of Patents and Trademarks*